US007926151B1

(12) United States Patent
MacWilliam

(10) Patent No.: US 7,926,151 B1
(45) Date of Patent: Apr. 19, 2011

(54) BUCKLE FASTENER SYSTEM AND METHOD

(76) Inventor: Karen L MacWilliam, Sugar Land, TX (US)

( * ) Notice: Subject to any disclaimer, the term of this patent is extended or adjusted under 35 U.S.C. 154(b) by 0 days.

(21) Appl. No.: 12/464,095

(22) Filed: May 11, 2009

(51) Int. Cl.
*A44B 11/24* (2006.01)
*A43B 9/00* (2006.01)

(52) U.S. Cl. ..... 24/163 R; 24/178; 36/11.5

(58) Field of Classification Search ..... 24/177–180, 24/163 R, 199, 312, 318, 319, 321, 165; 36/50.1, 36/11.5; 12/142 LC, 142 Q
See application file for complete search history.

(56) References Cited

U.S. PATENT DOCUMENTS

| | | | | | |
|---|---|---|---|---|---|
| 701,091 | A | * | 5/1902 | Sanders | 24/312 |
| 1,687,372 | A | * | 10/1928 | Legat | 24/163 R |
| RE19,292 | E | * | 8/1934 | Lerma | 24/163 R |
| 2,140,164 | A | * | 12/1938 | Moffatt | 24/199 |
| 2,193,943 | A | | 3/1940 | Shea | |
| 2,224,773 | A | * | 12/1940 | Shaulson | 24/200 |
| 3,088,184 | A | | 5/1963 | Bittner | |
| 3,447,208 | A | | 6/1969 | Beach | |
| 3,538,554 | A | | 11/1970 | Ford | |
| 3,566,454 | A | * | 3/1971 | Schmidt | 24/165 |
| 3,748,700 | A | | 7/1973 | Willey | |
| 3,855,637 | A | | 12/1974 | Luger | |
| 5,189,763 | A | | 3/1993 | Voumard | |
| 2006/0174514 | A1 | | 8/2006 | Scozzafava et al. | |

* cited by examiner

*Primary Examiner* — James R Brittain
(74) *Attorney, Agent, or Firm* — Kenneth A. Roddy

(57) ABSTRACT

A buckle fastener system and method for releasably fastening together two straps of an article utilizes a buckle attached to the free end of the first strap and a clasp member attached to the free end of the second strap of the article. The clasp member has a hook portion which slides onto the first strap adjacent to one end of the buckle and the clasp is positioned beneath the buckle such that the buckle is captured by the clasp to releasably fasten the first and second straps together. To unfasten the straps, the process is reversed.

2 Claims, 3 Drawing Sheets

BUCKLE FASTENER SYSTEM AND METHOD

BACKGROUND OF THE INVENTION

1. Field of the Invention

This invention relates generally to strap type buckles for footwear and other articles, and more particularly to a buckle fastener system and method utilizing a buckle and clasp for releasably fastening together two straps of an article such as footwear.

2. Background Art

Conventional buckle fasteners as applied to footwear and other articles typically comprise a buckle having a frame formed of a pair of laterally spaced bars adjoined by opposed first and second end bars, an intermediate bar disposed transversely between the laterally spaced bars which is secured in a loop formed at the free end of a first strap, and a retaining tongue or pin hingedly mounted on the intermediate bar extending through a hole in the loop. The free end of a second strap having a plurality of longitudinally spaced holes is threaded under the first end bar, over the intermediate bar and under the second end bar. The retaining pin end is received through a selected hole in the second strap prior it being threaded under the second end bars and its outer end is engaged on the first end bar and, thus, secures the two straps in a fastened position. This process is reversed to unfasten the buckle.

The repeated tensioning, fastening and unfastening of the conventional buckle subjects the straps to wear and after a period of time, the straps become worn and unsightly, and often results in failure or tearing of the loop portion of the strap carrying the buckle or stretching or tearing of the adjustment holes of the strap that is fed through the buckle.

There are various types of footwear known in the art such as sandals, and fashionable women's shoes that employ a conventional buckle fastener on the heel strap and/or the instep strap. There are also many fashionable women's shoes having an elevated heel wherein of the heel strap and/or the instep strap and/or loop that carries the buckle is made of an elastic material, known as a "stretch buckle" type of shoe that provides greater comfort than conventional non-stretch buckle fasteners which are generally characterized by being uncomfortable because the weight of a wearer bears against the thin heel and instep straps that are fastened around the ankle and/or instep.

There several patents that are directed toward various types of buckles and fastener arrangements.

Shea, U.S. Pat. No. 2,193,943 discloses a fabricated rubber sandal having a buckle which prevents a strap from slipping out of a slot, and the strap is fed through one slot and after being passed through a second slot is adjustably engaged with the buckle.

Bittner, U.S. Pat. No. 3,088,184 discloses a sliding buckle for strap ends wherein one strap end portion is provided with a series of aligned apertures, and the other strap end portion has an upstanding stud for selective engagement in one of the apertures, and a slide member carried thereon has a slot therein to slide over the apertured strap end portion and engage the stud to maintain the parts connected.

Beach, U.S. Pat. No. 3,447,208 discloses a tension buckle of molded nylon in the shape of a flat E-frame for symmetrical bridging connection between adjacent ends of a packaging strap. The E-shape includes a main endwise run carrying end-most cantilever arms or crossbars terminating in enlarged free ends and a center arm of U-shape to present intermediate crossbars joined by an endwise run portion. The endmost crossbars are larger in transverse section than the intermediate crossbars and are carried by portions of the main endwise run that are of maximum transverse section for increased resistance to bending. Each endmost crossbar and adjacent intermediate crossbar form a crossbar set to receive a strap end in a reverse fold configuration wherein a strap bight portion embraces the endmost crossbar and buckle-gripping and overlapping strap-gripping strap portions lead between the intermediate crossbars and then endwise beyond the strap bight portion.

Ford, U.S. Pat. No. 3,538,554 discloses a strap buckle formed of synthetic plastics has a flexible arm and two rigid arms through which the strap is threaded to overlie a stud-receiving aperture in the buckle so that the stud, when inserted forces the overlying portion of the strap into frictional engagement with said rigid arms.

Willey, U.S. Pat. No. 3,748,700 discloses a buckle, for fastening shoes or the like, the buckle comprising a buckle member and a securing member, one of the members comprising a projection which can be passed through an aperture in an article to which the buckle is to be attached and the other member being adapted to cooperate with said projection to secure the buckle to the article in a snap fit.

Luger, U.S. Pat. No. 3,855,637 discloses a belt reversing mechanism including two clamping sections rotatably connected to each other by a rivet or an eyelet. In one embodiment, one clamping section is connected to a belt buckle and the other clamping section is connected to a belt so that the belt may be rotated with respect to the belt buckle. In a second embodiment, the two clamping sections are identical and serve to connect two belt sections so that they may be rotated with respect to each other so that either side of a belt section may be visible when the belt is worn.

Voumard, U.S. Pat. No. 5,189,763 discloses a strap clasp that includes a first part composed of a base plate surmounted by at least one stud, the first part being inserted in one or more holes of two superimposed lengths of a watch strap, and a second part surrounding the two lengths of watch strap. The top portion of the second part is provided with a longitudinal slot extending to at least one edge of the top portion in which a notch is intended to receive the end of a stud.

Scozzafava et al, published pending U.S. Patent Application 2006/0174514 discloses footwear wherein the upper, or straps, may be interchanged, in order to alter the style, material, hardware, or other appearance of the footwear, which is achieved by a three part clip and loop design. The base of the shoe is outfitted with an integrated loop, to which the clip is attached. All straps are made with integrated loops at the ends and the loops are then attached to the clip by sliding each end through the integral opening in the clip.

SUMMARY OF THE INVENTION

The present invention overcomes the aforementioned problems and is distinguished over the prior art in general, and these patents in particular by a buckle fastener system and method for releasably fastening together two straps of an article that utilizes a buckle attached to the free end of the first strap and a clasp member attached to the free end of the second strap of the article. The clasp member has a hook portion which slides onto the first strap adjacent to one end of the buckle and the clasp is positioned beneath the buckle such that the buckle is captured by the clasp to releasably fasten the first and second straps together. To unfasten the straps, the process is reversed.

One of the features and advantages of the present invention is that it will eliminate the unsightly appearance of worn straps and significantly reduce torn ear and failure or tearing of the loop portion of the strap carrying the buckle or stretching or tearing of the adjustment holes of the strap that is fed through the buckle caused by repeated tensioning, fastening and unfastening of conventional buckles.

Another feature and advantage of the present invention is that it allows two straps of an article to be connected together and disconnected easily and quickly.

Another feature and advantage of the present invention is that it may be easily incorporated into a wide variety of articles such as: garments, backpacks, purses, bags, belts, etc.

Another feature and advantage of the present invention is that it utilizes a buckle on a first strap of an article and a clasp member on a second strap of the article releasably engageable with the first strap and buckle wherein the buckle is selectively adjustably positioned on the first strap for increasing or decreasing, respectively, the effective length of the first strap and, thus, the tension of the straps in a fastened condition.

Another feature and advantage of the present invention is that it may be easily incorporated into various articles such as, for example, the heel strap and/or the instep strap of footwear.

Another feature and advantage of the present invention is that it may be easily incorporated into various articles such as, for example, the heel strap and/or the instep strap of footwear which have an elastic strap and/or loop that will provide greater comfort than conventional non-stretch buckle fasteners.

A further feature and advantage of the present invention is that it may be easily and quickly retrofitted on a wide variety of articles such as: footwear, garments, backpacks, purses, bags, belts, carrying cases, shoulder straps, etc., to replace the existing buckle fastener.

A still further feature and advantage of the present invention is that is simple in construction, inexpensive to manufacture, attractive in appearance, and rugged and reliable in operation.

Other features and advantages of the invention will become apparent from time to time throughout the specification and claims as hereinafter related.

DESCRIPTION OF THE PREFERRED EMBODIMENTS

Detailed descriptions of the preferred embodiments are provided herein. It is to be understood, however, that the present invention may be embodied in various forms. Therefore, specific details disclosed herein are not to be interpreted as limiting, but rather as a basis for the claims and as a representative basis for teaching one skilled in the art to employ the present invention.

Figure 1:
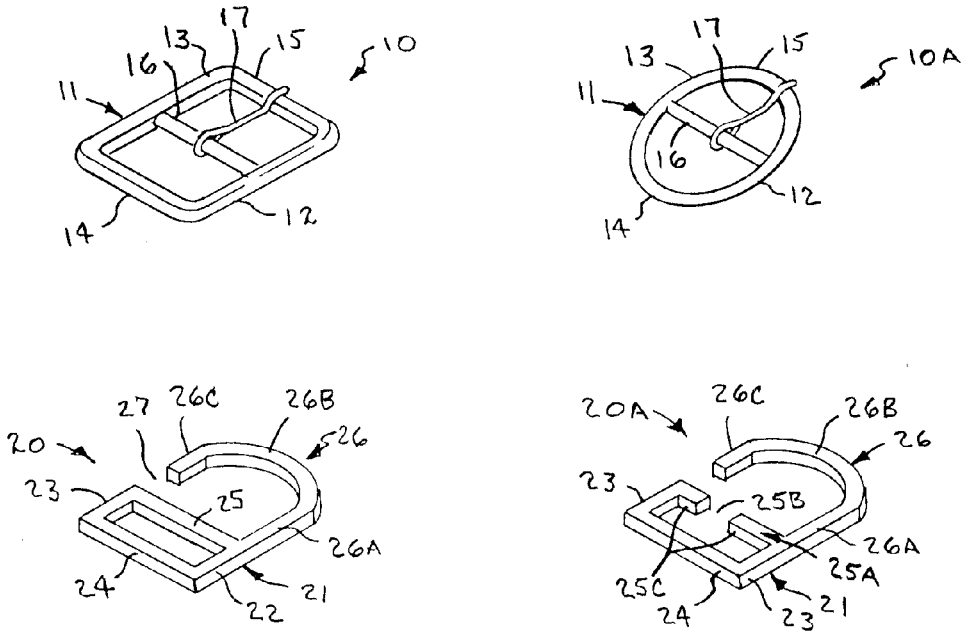
FIG. 1 is a perspective view of the basic components of the buckle fastening system in accordance with the present invention, namely, a buckle member depicted in two different styles and two embodiments of a clasp member for releasably fastening together two straps of an article.

Referring now to FIG. 1 of the drawings by numerals of reference, the buckle fastening system of the present invention utilizes two basic components; a buckle member and a clasp member designed to be releasably connected with the buckle member for releasably fastening two straps of an article, such as footwear. FIG. 1 shows, for purposes of example only, two different styles of the buckle member; a generally rectangular buckle member 10 and a generally oval-shaped buckle member 10A. However, it should be understood that the buckle member may be configured differently; for example, it may have a generally circular or other suitable shape or configuration.

FIG. 1 also shows, for purposes of example only, a first clasp member 20 that may be permanently secured to loop and the end of a strap, and a second clasp member 20A which is modified so as to be removably installed on an existing loop, which allows the buckle fastening system to be retrofitted on preexisting straps having a loop at the outer end.

The buckle members 10 and 10A are of conventional construction having a frame 11 formed of a pair of laterally spaced side portions 12 and 13 adjoined at their ends by opposed first and second end portions 14 and 15, an intermediate bar 16 disposed transversely between the laterally spaced side portions, and a retaining tongue or pin 17 hingedly mounted on the intermediate bar having a free end extending outwardly from the hinged end.

Figure 2:
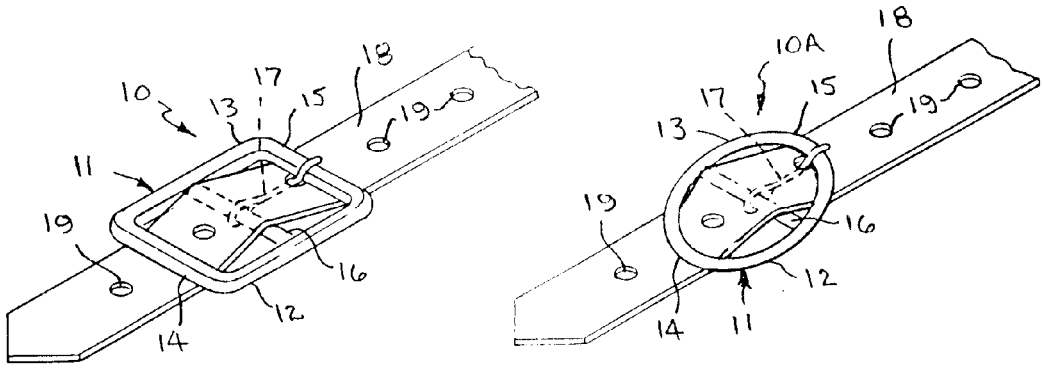
FIG. 2 is a perspective view of two different styles of the buckle member attached to the free end of a first strap of an article.

As shown in FIG. 2, unlike a conventional buckle, the buckle member 10 or 10A of the present invention is not secured in a loop at the end of strap; instead, the free end of a first strap 18 having a plurality of longitudinally spaced holes 19 is threaded under the first end portion 14, over the intermediate bar 16 and under the second end portion 15 and the hinged retaining tongue or pin 17 extends through a selected hole 19 in the free end of the strap 18. The buckle member 10 or 10A remains on the strap 18 having the plurality of longitudinally spaced holes.

Referring again to FIG. 1, the first embodiment of the clasp member 20 has a frame 21 formed of a pair of laterally spaced side portions 22 and 23 adjoined at one end by a transverse end bar 24 and a transverse intermediate bar 25 spaced a short distance above the end bar. A generally J-shaped hook portion 26 adjoins one of the laterally spaced side portions 23. The generally J-shaped hook portion 26 has a longer lateral side portion 26A that extends from the intermediate bar 25 toward the end opposite the transverse end bar 24, a curved transverse end portion 26B that extends transversely toward the other laterally spaced side portion 22, and a shorter lateral side portion 26C that extends toward the intermediate bar 25 terminating a distance therefrom to form an opening or gap 27 therebetween. Thus, the generally squared J-shaped hook portion 26 forms a hook at the forward end of the clasp member 20 for receiving the first strap 18 on which the buckle 10 or 10A is attached.

Figure 3:
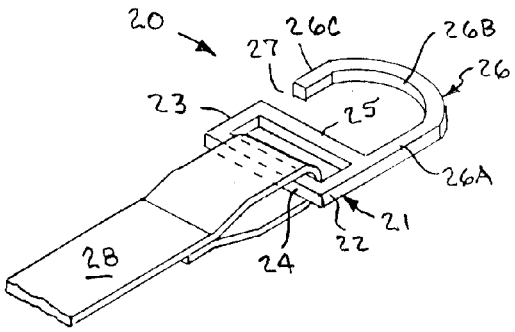
FIG. 3 is a perspective view of the first embodiment of the clasp member secured in a loop at the free end of a second strap member.

As shown in FIG. 3, the free end of a second strap 28 is looped over the end bar 27 and secured onto itself by conventional means such as sewing or conventional permanent fasteners, to secure the clasp 20 onto the loop 29 of the strap.

Referring again to FIG. 1, the modified clasp member 20A also has a frame 21 formed of a pair of laterally spaced side portions 22 and 23 adjoined at one end by a transverse end bar 24. In this modification the clasp has a transverse segmented intermediate bar 25A which is segmented by a gap 25B to form a pair of inward facing axially aligned short segments 25C spaced a short distance above the end bar 24. A generally J-shaped hook portion 26 adjoins one of the laterally spaced side portions 23. The generally J-shaped hook portion 26 has a longer lateral side portion 26A that extends from the intermediate bar 25A toward the end opposite the transverse end bar 24, a curved transverse end portion 26B that extends transversely toward the other laterally spaced side portion 22, and a shorter lateral side portion 26C that extends toward the intermediate bar 24A terminating a distance therefrom to form an opening or gap 27 therebetween. Thus, the generally squared J-shaped hook portion 26 forms a hook at the forward end of the clasp member 20A for receiving the first strap 18 on which the buckle 10 or 10A is attached; and the segments 25B, 25C of the segmented intermediate bar 25A, side portions 22, 23, and end bar 24 form a second generally squared U-shaped hook at the rearward end, or end opposite the J-shaped hook, for receiving a loop 29 of a second strap 28, as described below.

The modified clasp member 20A allows the present fastening system to be retrofitted on preexisting straps having a loop at the outer end. Typically, the strap of the article being retrofitted, such as footwear, will have a conventional buckle secured in a loop formed at the free end of the strap, and a retaining tongue or pin hingedly mounted on the intermediate bar extending through a hole in the loop. When retrofitting the article with the present buckle fastening system, the existing buckle is removed by cutting one of the laterally spaced sides or end portions of the buckle with a wire cutter or other suitable tool and pulling the existing buckle out of the loop.

Figure 4:
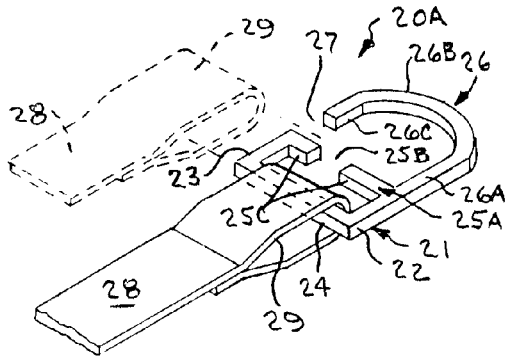
FIG. 4 is an exploded perspective views illustrating how the second embodiment of the clasp member is releasably attached in an existing loop at the free end of a second strap.

FIG. 4 is an exploded perspective view illustrating how the modified clasp member 20A is releasably attached in an existing loop 29 at the free end of a second strap 28, after the existing buckle has been removed. An existing loop 29 at the free end of a second strap 28 is shown in dashed line on the left-hand side of the clasp 20A prior to attachment. The side of the clasp 20A having the terminating end of the J-shaped hook 26 and gap 27 is aligned with the existing loop 29, and the loop is fed through the gap 27 at the side and through the gap 25B of the segmented intermediate bar 25A to be received on the end bar 24 beneath the segmented intermediate bar, as shown in solid line in FIG. 4.

It should be understood that either or both of the straps 18 and 29 and/or the loop 30 may be formed of non-elastic or elastic materials, and that the buckles and/or the clasps may be formed of metallic or non-metallic materials.

Figure 5:
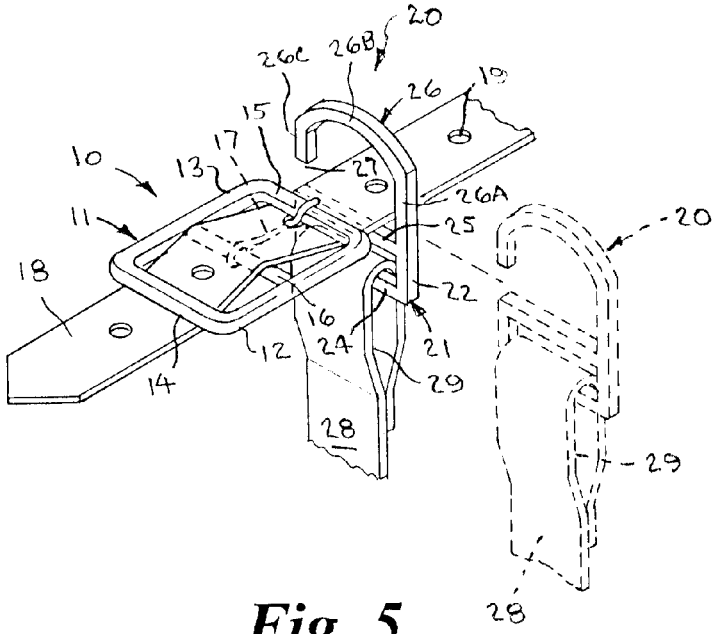
FIGS. 5 and 6 are exploded perspective views illustrating how the clasp member is releasably connected onto the first strap adjacent to the buckle.
Figure 6:
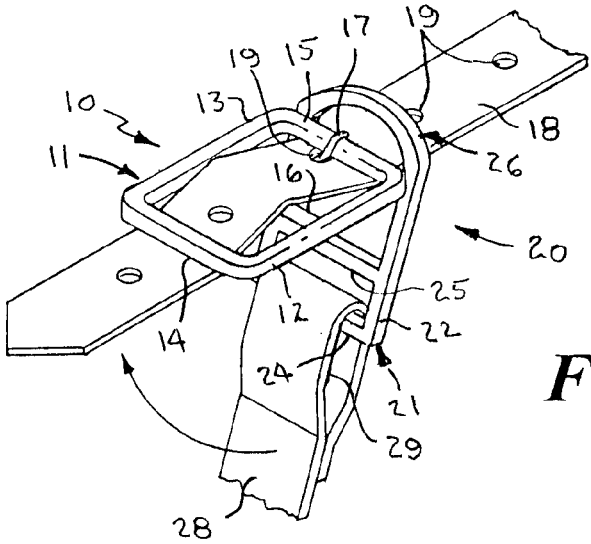
Figure 7:
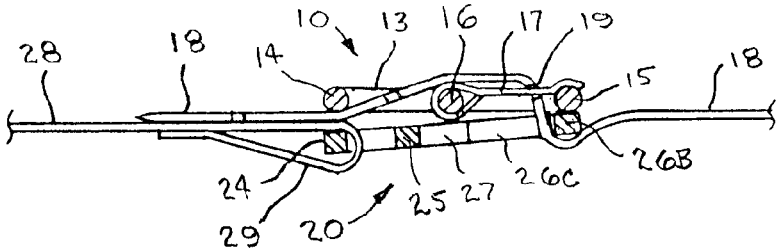
FIG. 7 is a cross sectional view in a larger scale, showing the clasp member releasably engaged beneath the buckle in the fastened condition.

FIGS. 5, 6, and 7 illustrate how the buckle and clasp are releasably connected. For purposes of example only, the buckle member depicted in these figures is the generally rectangular buckle 10 and the clasp member is the first embodiment of the clasp member 20. As described above, the free end of the first strap 18 having a plurality of longitudinally spaced holes 19 is threaded under the first end portion 14, over the intermediate bar 16 and under the second end portion 15 and the hinged retaining tongue or pin 17 is extended through a selected hole 19 in the free end of the strap 18. It should be understood that the hole selected is the one which would provide a comfortable fit around the ankle or instep, or the desired strap length if used on other articles. This may be determined prior to installing the buckle 10 by placing the first strap 18 with the plurality of holes over the ankle or instep, or in the desired fastened position, and then overlapping it with the second strap 28 carrying the clasp 20. The hole that appears closest to the center of the J-shaped hook 26 is the one through which the retaining tongue or pin 17 should be extended when the buckle is installed.

As shown in FIG. 5, after the buckle 10 has been installed on the first strap 18, the gap 27 at the side of the clasp 20 is aligned with the first strap 18 near the end 15 of the buckle 10 on which the outer end of the tongue or pin tongue or pin 17 is engaged (shown in dashed line), and the clasp is moved onto the strap (shown in solid line). As shown in FIG. 6, the clasp is then lowered onto the strap 18 such that the transverse curved end portion 26B of the J-shaped hook 26 is disposed adjacent to the end 15 of the buckle 10. The second strap 28 is then pulled upwardly and outwardly relative to the buckle 10, such that the clasp 20 is disposed under the buckle with the transverse curved end portion 26B of the J-shaped hook 26 disposed beneath the end 15 of the buckle, as shown in cross section in FIG. 7. Thus, the buckle 10 is captured by the clasp 20 to releasably fasten the first and second straps 18 and 28 together. Tension on the straps aids in maintaining the buckle and clasp in the fastened position. To unfasten the straps, the process just described is reversed.

Figure 8:
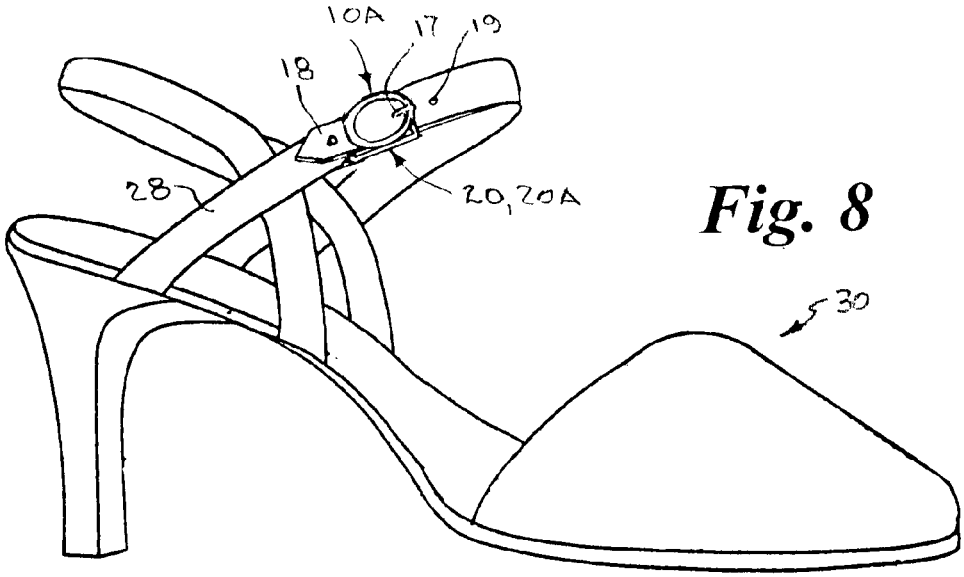
FIG. 8 is a perspective view of an example of the buckle and clasp according to the present invention employed on the ankle straps of a woman's strap-type dress shoe.

FIG. 8 shows a buckle 10A and clasp 20 according to the present invention employed, for example only but not limited thereto, on the ankle straps 18 and 28 of a woman's strap-type dress shoe 30.

It should be understood that the present buckle fastening system may be employed on various other types of articles such as: garments, backpacks, purses, bags, belts, carrying cases, shoulder straps, etc.

While the present invention has been disclosed in various preferred forms, the specific embodiments thereof as disclosed and illustrated herein are considered as illustrative only of the principles of the invention and are not to be considered in a limiting sense in interpreting the claims. The claims are intended to include all novel and non-obvious combinations and sub-combinations of the various elements, features, functions, and/or properties disclosed herein. Variations in size, materials, shape, form, function and manner of operation, assembly and use, are deemed readily apparent and obvious to one skilled in the art from this disclosure, and all equivalent relationships to those illustrated in the drawings and described in the specification are intended to be encompassed in the following claims defining the present invention.

The invention claimed is:

1. A method for retrofitting an article of footwear with a buckle fastener system wherein the article of footwear comprises a first strap having a free end and longitudinally spaced apertures therethrough and a second strap having an existing buckle in a loop at a free end thereof, the method comprising the steps of:

providing a replacement buckle member having an open frame defined by laterally spaced side portions, opposed first and second end portions and an intermediate transverse bar portion extending between said laterally spaced side portions, and a tongue pivotally connected with said intermediate bar portion and having an outer end configured to be passed through a selected aperture in the first strap and engaged on said first end portion for securing said replacement buckle member to the first strap;

providing a clasp member having a frame with lateral side portions, a transverse end bar at a first end adjoined to said side portions, a segmented transverse intermediate bar extending between said lateral side portions in parallel spaced relation to said transverse end bar defining a space therebetween, said segmented transverse intermediate bar having axially aligned segments extending inwardly from respective said lateral side portions in laterally opposed relation defining an opening into said space for receiving the loop at the free end of the second strap, and a generally J-shaped hook portion at a second end, said hook portion having a longer straight first lateral side portion, a transverse intermediate portion, and a shorter second lateral second side portion terminating a short distance from said segmented transverse intermediate bar defining a gap therebetween on a side of said clasp member for laterally receiving the first strap;

removing the existing buckle from the loop at the free end of the second strap;

installing said clasp member on the second strap by sliding said gap on the side of said clasp member laterally onto the loop at the free end of the second strap such that the loop passes through said opening in said segmented transverse intermediate bar and said transverse end bar is received through the loop and retained therein;

installing said replacement buckle member on the first strap by threading the free end of the first strap under said first end portion of said buckle member, over said intermediate bar, and under said second end portion thereof, extending said tongue of said buckle member through a selected hole in the free end of the first strap, and engaging its said outer end on said buckle member first end portion; and thereafter to fasten the first and second straps together, said clasp member hook portion is hooked onto the first strap by sliding said gap on the side of said clasp member laterally onto the first strap and positioning said hook portion beneath said first end portion of said replacement buckle member on which said tongue member outer end is engaged, so as to be captured between said first end portion of said buckle member and the selected aperture through which said tongue member is passed and thereby retain the first and second straps fastened together; and to unfasten the first and second straps, said clasp member hook portion is unhooked from the first strap by sliding said gap on the side of said clasp member laterally off of the first strap and said hook portion from beneath said first end portion of said replacement buckle member.

2. The method according to claim 1, wherein said step of removing the existing buckle from the loop at the free end of the second strap comprises cutting a lateral side portion or end portion of the existing buckle with a wire cutting tool and pulling the existing buckle out of the loop.

* * * * *